US008265987B2

(12) United States Patent
Goto

(10) Patent No.: US 8,265,987 B2
(45) Date of Patent: Sep. 11, 2012

(54) ROAD-VEHICLE COMMUNICATION SYSTEM

(75) Inventor: Souju Goto, Yokohama (JP)

(73) Assignee: Kabushiki Kaisha Kenwood, Hachiouji-shi, Tokyo (JP)

( * ) Notice: Subject to any disclaimer, the term of this patent is extended or adjusted under 35 U.S.C. 154(b) by 178 days.

(21) Appl. No.: 12/747,072

(22) PCT Filed: Dec. 17, 2008

(86) PCT No.: PCT/JP2008/072986

§ 371 (c)(1),
(2), (4) Date: Jun. 9, 2010

(87) PCT Pub. No.: WO2009/081817

PCT Pub. Date: Jul. 2, 2009

(65) Prior Publication Data

US 2011/0010228 A1 Jan. 13, 2011

(30) Foreign Application Priority Data

Dec. 20, 2007 (JP) ..... 2007-329118

(51) Int. Cl.
*G07B 15/00* (2011.01)
*G08G 1/00* (2006.01)

(52) U.S. Cl. ..... 705/13; 340/928; 235/384

(58) Field of Classification Search ..... 705/13; 235/384; 340/928
See application file for complete search history.

(56) References Cited

U.S. PATENT DOCUMENTS 5,203,422 A * 4/1993 Estep et al. ..... 180/169
6,042,008 A * 3/2000 Ando et al. ..... 235/384
6,084,533 A * 7/2000 Morgan et al. ..... 340/935
2006/0044161 A1 * 3/2006 Feldman et al. ..... 340/933

FOREIGN PATENT DOCUMENTS

| | | |
|---|---|---|
| JP | 59-85600 | 5/1984 |
| JP | 08-069598 | 3/1996 |
| JP | 2003-151077 | 5/2003 |
| JP | 2007-183799 | 7/2007 |

OTHER PUBLICATIONS

"New Product Deters Wrong-Way Drivers; Intelligent Perimeter Systems' Vehicle Alert Detection System Sounds and Flashes Alarm When Vehicle Enters Roadway from the Wrong Direction and Sends Alert to Law Enforcement", Business Wire, May 16, 2005.*

International Search Report for Application Serial No. PCT/JP2008/072986.

Notification of Transmittal of Translation of the International Preliminary Report on Patentability (Application No. PCT/JP2008/072986) dated Jul. 29, 2010.

* cited by examiner

*Primary Examiner* — Kevin Flynn
(74) *Attorney, Agent, or Firm* — Eric J. Robinson; Robinson Intellectual Property Law Office, P.C.

(57) ABSTRACT

A road-vehicle communication system warns or gives caution to a vehicle traveling in a reverse way direction and may also give warning to vehicles traveling in a correct direction. The road-vehicle communication system includes a first roadside apparatus at an entrance gate that gives entry gate pass information indicating that a vehicle passing a communicative area has entered a toll road. A second roadside apparatus at an exit ramp acquires any given entry gate pass information from a passing vehicle. An administration device judges whether or not the entry gate pass information is acquired from the passing vehicle. If the entry gate pass information is not acquired, the second roadside apparatus provides the vehicle with reverse-way driving warning information for warning the vehicle that the vehicle is traveling in the reverse direction.

5 Claims, 8 Drawing Sheets

ROAD-VEHICLE COMMUNICATION SYSTEM

TECHNICAL FIELD

The present invention relates to a road-vehicle communication system that prevents traveling in a reverse way on a toll road.

BACKGROUND ART

Conventionally, there is known a road-vehicle communication system that includes a roadside apparatus installed on a road and vehicle-mounted device mounted on a vehicle and performs two-way wireless communication between the roadside apparatus and the vehicle-mounted device. In this road-vehicle communication system, for example, a short-range communication system called DSRC (Dedicated Short Range Communication) is adopted.

The vehicle-mounted is capable of performing the short-range wireless communication with the roadside apparatus and receiving information provision from a center apparatus via the roadside apparatus. Specifically, only in a period when the vehicle is within a communication range of the roadside apparatus, two-way communication between the vehicle-mounted device and the roadside apparatus is possible. Information is provided from the center apparatus to the vehicle-mounted device via the roadside apparatus in this period.

The road-vehicle communication system can provide the vehicle-mounted device with information for supporting traveling such as information indicating that there is an obstacle such as a stalled vehicle ahead on a road or there is a junction ahead. Therefore, the road-vehicle communication system is extremely effective for preventing traffic accidents.

Incidentally, in recent years, an accident of collision of a forward traveling vehicle and a reverse-way traveling vehicle in a one-way road such as a toll road (a reverse-way traveling accident) frequently occurs and poses a problem. This reverse-way traveling accident is caused by, for example, a vehicle entering the toll road from an exit ramp by mistake or traveling an entry road in a reverse way in returning from a service area or a parking area (hereafter referred to as SA/PA) to a main lane.

As a measure for preventing reverse-way traveling in the toll road, for example, attention is called by a road sign or a road surface display that indicates that a road is a one-way road. A technique for warning, using a road-vehicle communication system, a driver that the driver is traveling in a reverse way is proposed (e.g., Patent Document 1).

The road-vehicle communication system described in Patent Document 1 transmits entry information from a roadside apparatus to vehicle-mounted device, for example, in an interchange of a toll road and outputs sound such as "enter a toll road" or "please be careful about a reverse-way traveling" to warn the driver and call attention of the driver to not travel in a reverse way.

Patent Document 1: Japanese Patent Application Laid-Open No. 2007-102443

DISCLOSURE OF THE INVENTION

Problems to be Solved by the Invention

However, in the technique described in Patent Document 1, the entry information is transmitted to all vehicles passing through the vicinity of the roadside apparatus to perform warning for calling attention. Therefore, it is likely that this warning is annoying for a driver who is attempting to travel forward.

Therefore, if it is possible to perform warning for reverse-way traveling prevention only for vehicles that is extremely fully expected to travel a main lane of a toll road in a reverse way, for example, enter the main lane from an exit ramp by mistake or travel in a reverse way on an entry road of the SA/PA, it is possible to effectively prevent reverse-way traveling without giving an unpleasant feeling to a driver of a forward traveling vehicle.

If it is possible to notify a vehicle traveling the main lane that a vehicle extremely fully expected to travel the main lane of the toll road in a reverse way is present, the vehicle can take measures by, for example, moving to and traveling a passing lane in advance. Therefore, it is highly likely that a reverse-way traveling accident can be prevented.

It is an object of the present invention to provide a road-vehicle communication system that warns or cautions, if a vehicle that is extremely fully expected to travel in a reverse way on a one-way road such as a toll road is present, the reverse-way traveling vehicle and a vehicle traveling a main lane.

Means for Solving the Problems

In order to attain the object, a road-vehicle communication system according to the present invention basically includes: a first roadside apparatus that is provided in an entrance ramp of a toll road and gives, to a vehicle passing through a communicable range, entry gate pass information; a second roadside apparatus that is provided in an exit ramp of the toll road and acquires the entry gate pass information given by the first roadside apparatus from the vehicle passing through the communicable range; and an administration device that can communicate with the second roadside apparatus. The administration device operates to judge whether the entry gate pass information is acquired from the passing vehicle by the second roadside apparatus and provide, if this entry gate pass information is not acquired, via the second roadside apparatus, reverse-way traveling warning information for warning the vehicle that the vehicle is traveling in a reverse way.

In a first embodiment of the communication system according to the present invention, the first roadside apparatus is provided in an ETC entry gate.

In a second embodiment of the communication system according to the present invention, the second roadside apparatus is provided in an ETC exit gate. The administration device operates to calculate, if the entry gate pass information is acquired from the passing vehicle by the second roadside apparatus, a toll corresponding to a traveling section of the toll road on the basis of the entry gate pass information and provide the vehicle with payment information via the second roadside apparatus.

In a third embodiment of the communication system according to the present invention, the communication system includes a third roadside apparatus that is provided further on an upstream side than a turning point to the exit ramp of a main lane of the toll road and performs short-range communication with vehicle-mounted device mounted on the vehicle. The administration device is configured to be capable of communicating with the third roadside apparatus and provide, if the entry gate pass information is not acquired from the passing vehicle by the second roadside apparatus, via the third roadside apparatus, a vehicle traveling the main lane of the toll road with reverse-way traveling vehicle warning information for alerting that a reverse-way traveling vehicle is present.

Further, in a fourth embodiment of the communication system according to the present invention, the second roadside apparatus acquires vehicle identification information from the vehicle passing through a communicable range. The administration device is configured to store, if the entry pass gate information is not acquired from the passing vehicle by the second roadside apparatus, vehicle identification information of the vehicle in advance and stop the provision of the reverse-way traveling vehicle warning information when the vehicle identification information of the vehicle is acquired by the second roadside apparatus again.

Preferably, in the road-vehicle communication system according to the present invention, the entry gate pass information is stored in the vehicle-mounted device mounted on the vehicle.

Effects of the Invention

With the road-vehicle communication system according to the present invention, if a vehicle that is extremely fully expected to travel in a reverse way on a one-way road such as a toll road is present, the communication system warns or cautions the reverse-way traveling vehicle and a vehicle traveling a main lane. Therefore, it is possible to effectively prevent a reverse-way traveling accident in the toll road.

DESCRIPTION OF SYMBOLS

Figure 1:
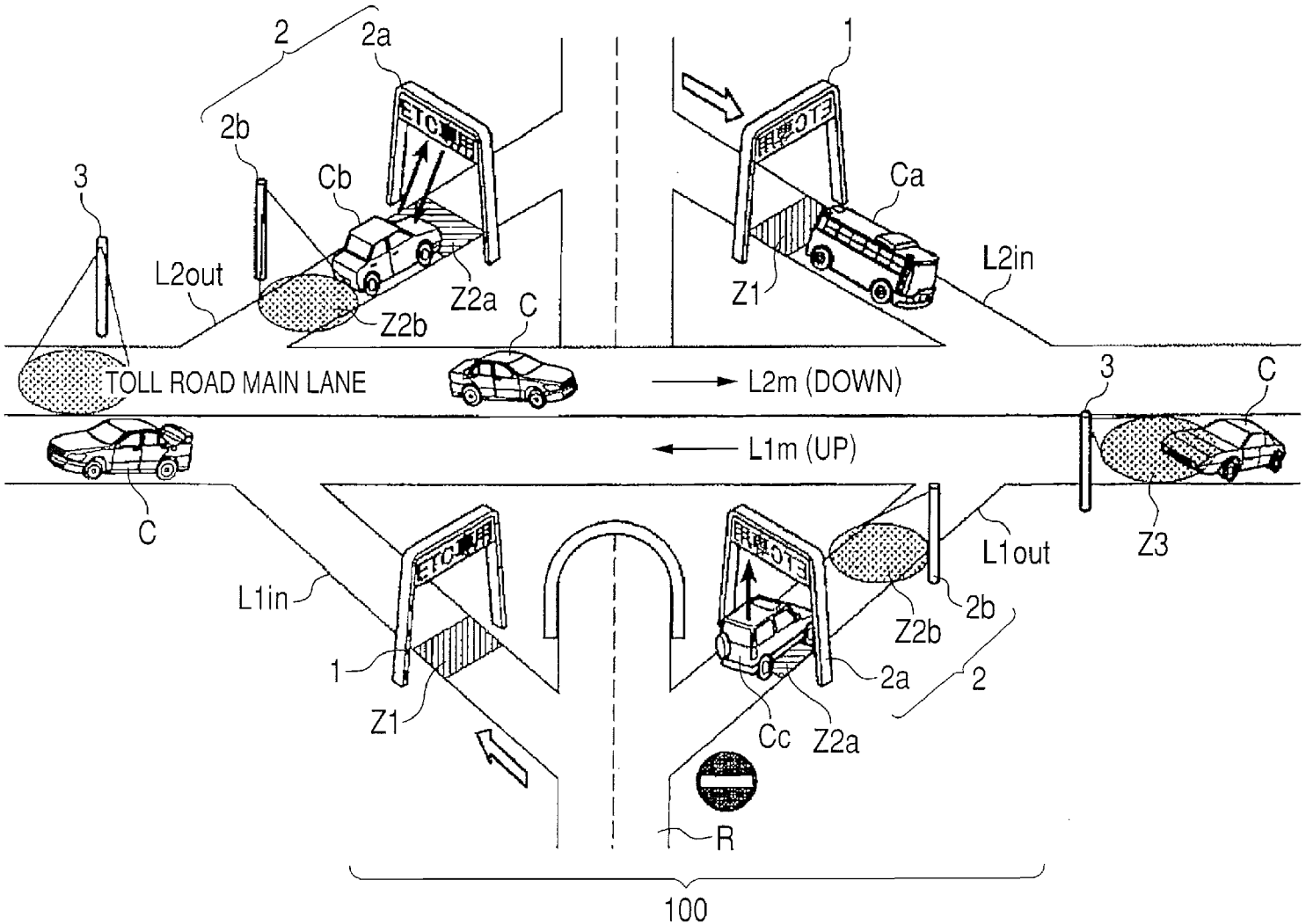
FIG. 1 is a schematic diagram showing an example of an installation state of a road-vehicle communication system according to the present invention.

1 first roadside apparatus (ETC entry gate)
11 control section
111 CPU
112 ROM
113 RAM
12 DSRC communication unit
2 second roadside apparatus (ETC exit gate)
21 control section (administration device)
211 CPU
212 ROM
213 RAM
22 DSRC communication unit
23 network communication unit
24 provided information storage unit (reverse-way traveling warning information)
3 third roadside apparatus
31 control section (administration device)
311 CPU
312 ROM
313 RAM
32 DSRC communication unit
33 network communication unit
34 provided information storage unit (reverse-way traveling vehicle caution information)
5 vehicle-mounted device
100 road-vehicle communication system

BEST MODES FOR CARRYING OUT THE INVENTION

An embodiment of the present invention is explained below on the basis of the drawings.

FIG. 1 is a schematic diagram showing an example of an installation state of a road-vehicle communication system according to the present invention.

As shown in FIG. 1, a road-vehicle communication system 100 according to this embodiment includes first roadside apparatuses 1 installed in entrance ramps L1in and L2in that enter main lanes L1*m* and L2*m* of a toll road, second roadside apparatuses 2 (2*a* and 2*b*) installed in exit ramps L1out and L2out that exit from the main lanes L1*m* and L2*m*, and third roadside apparatuses 3 installed further on upstream sides than turning points to the exit ramps L1out and L2out on the main lanes L1*m* and L2*m*.

At different two points in a one-way road, the point through which a vehicle passes earlier is represented as upstream side and the point through which the vehicle passes later is represented as downstream side. Specifically, in the main lanes L1*m* and L2*m* of the toll road, the third roadside apparatuses 3 are installed further on the upstream sides than the turning points to the exit ramps L1out and L2out.

In the road-vehicle communication system 100 according to this embodiment, a roadside apparatus provided in an ETC entry gate in a conventional ETC (Electronic Toll Collection system) is represented as first roadside apparatus and a roadside apparatus provided in an ETC exit gate is represented as second roadside apparatus 2 (2*a*). In other words, the conventional ETC is improved and used for reverse-way traveling prevention.

In FIG. 1, concerning the second roadside apparatus 2, antennas 2*a* and 2*b* that perform transmission and reception of information to and from a passing vehicle C are separately shown. The same holds true for the first roadside apparatus 1 (see FIG. 3). In the ETC exit and entry gate, since a toll for the toll road has to be collected from the traveling vehicle C, two antennas for transmission and reception are provided to make it possible to surely transmit and receive information.

In the following explanation, when a roadside apparatus is simply described as a roadside apparatus, this indicates that the roadside apparatus is a roadside apparatus used in a general road-vehicle communication system.

Usually, vehicles C, C, . . . travel in one direction in each of the up main lane L1*m* and the down main lane L2*m* of the toll road.

The vehicle C travels on the entrance ramp L1in to enters the up main lane L1*m* and travels on the entrance ramp L2in to enter the down main lane L2*m* (a vehicle Ca). The vehicle C travels on the exit ramp L1out from the up main lane L1*m* to exit to a general road R and travels on the exit ramp L2out from the down main lane L2*m* to exit to the general road R (Cb).

On the other hand, when a vehicle Cc is travels on the exit ramp L1out to be about to enter the main lane L1*m*, this vehicle Cc travels in a reverse way on the exit ramp L1out. It is extremely fully expected that the vehicle Cc travels the main lane L1*m* in a reverse way as well.

In this embodiment, the road-vehicle communication system 100 warns a vehicle extremely fully expected to travel the main lanes L1*m* and L2*m* in a reverse way (e.g., the vehicle Cc) that the vehicle is traveling in a reverse way and prevents a reverse-way traveling accident from occurring on the main lanes L1*m* and L2*m* of the toll road.

The road-vehicle communication system 100 notifies the vehicle C traveling the main lanes L1*m* and L2*m* that the vehicle highly fully expected to travel the main lanes L1*m* and L2*m* in a reverse way is present and causes the vehicle C to take a measure by, for example, moving to and traveling a passing lane in advance. In this way, the road-vehicle communication system 100 prevents occurrence of a reverse-way traveling accident.

Figure 2:
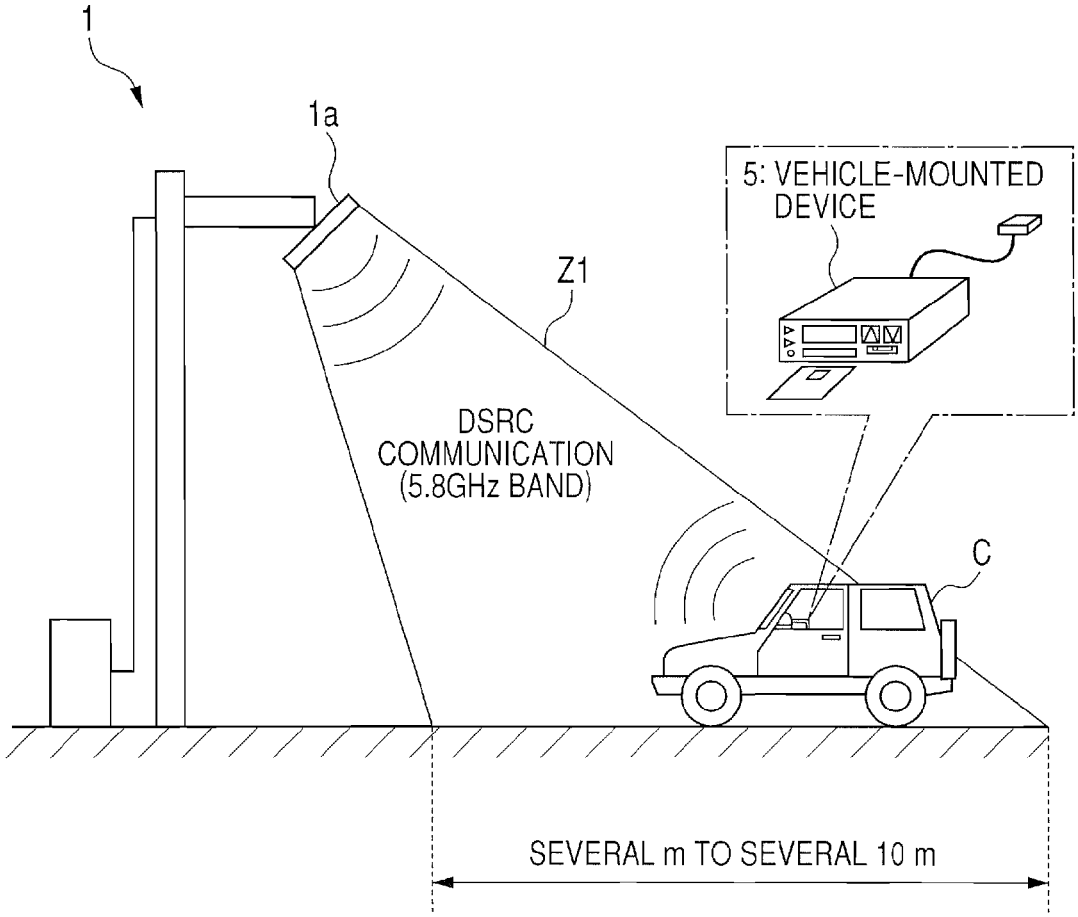
FIG. 2 is an explanatory diagram of a roadside area that is a communicable range of a roadside apparatus.

FIG. 2 is an explanatory diagram of a roadside area that is a communicable range of a roadside apparatus. A roadside area Z1 of the first roadside apparatus 1 is shown in FIG. 2.

As shown in FIG. 2, the first roadside apparatus 1 radiates a DSRC radio wave having a limited reaching distance from the antenna 1*a* installed beside a road or above the road and forms the roadside area Z1 near the roadside apparatus. The DSRC is a short-range communication system employing a radio wave in a 5.8 GHz band. A communication range of the DSRC is set to, for example, several meters to several tens of meters.

In general, in a road-vehicle communication system, a plurality of roadside apparatuses are installed. However, since all outputs of DSRC radio waves from the roadside apparatuses are set to the same degree, roadside areas respectively formed by the plurality of roadside apparatuses are substantially fixed irrespectively of installing locations.

In this embodiment, the first roadside apparatuses 1, the second roadside apparatuses 2*a* and 2*b*, and the third roadside apparatuses 3 form equivalent roadside areas Z1, Z2*a*, Z2*b*, and Z3 (see FIG. 1). The roadside apparatuses can perform two-way wireless communication (road-vehicle communication) with only vehicle-mounted device 5 mounted on the vehicles C present in the respective roadside areas.

Figure 3:
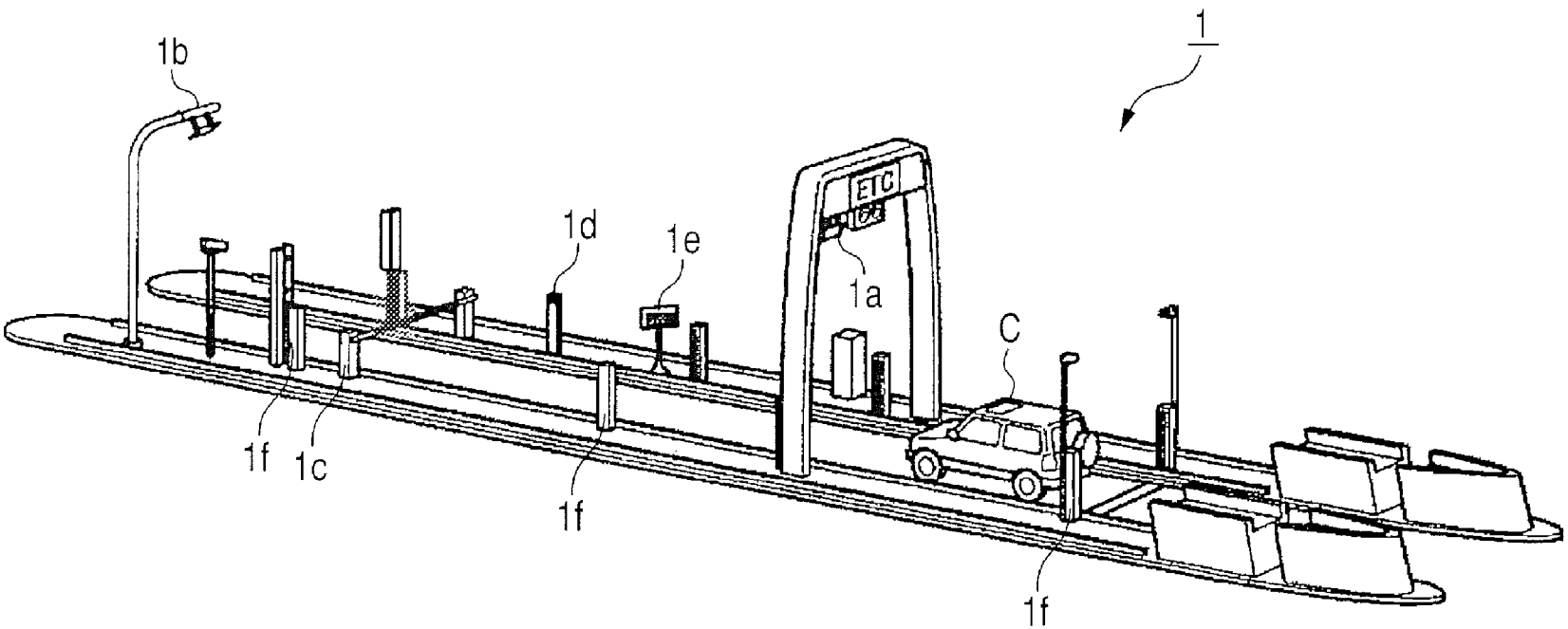
FIG. 3 is an explanatory diagram showing the structure of an ETC gate.

FIG. 3 is an explanatory diagram showing the general structure of an ETC gate. In FIG. 3, the first roadside apparatus 1 as an ETC entry gate is shown. However, the second roadside apparatus 2 as an ETC exit gate has the same structure.

As shown in FIG. 3, the first roadside apparatus includes the antennas 1*a* and 1*b* that perform transmission and reception of information with the vehicle C passing through the roadside area Z1, a start control device 1*c* including an opening and closing bar for controlling passage of a vehicle, an intercom 1*d* for making contact with a person in charge when abnormality occurs in the start control device 1*c* or the like, a roadside display 1*e* that displays a type of a passing vehicle, a toll, and the like, and a vehicle detector if that detects a vehicle passing through an ETC gate.

In general, an ETC entry gate performs short-range communication with the vehicle-mounted device 5 mounted on a vehicle passing through this ETC entry gate and entering a toll road to thereby give, to the vehicle C, entry gate pass information indicating that the vehicle C enters the toll road.

An ETC exit gate performs short-range communication with the vehicle-mounted device 5 mounted on the vehicle passing through this ETC exit gate and entering a general road to thereby acquire the entry gate pass information from the vehicle. The ETC exit gate calculates a toll corresponding to a traveling section of the toll road on the basis of this entry gate pass information and transmits payment information to the vehicle C.

Further, in this embodiment, when the ETC exit gate (the second roadside apparatus 2*a*) cannot acquire effective entry gate pass information from the passing vehicle C, the ETC exit gate judges that the vehicle is a reverse-way traveling vehicle and warns the vehicle.

Figure 4:
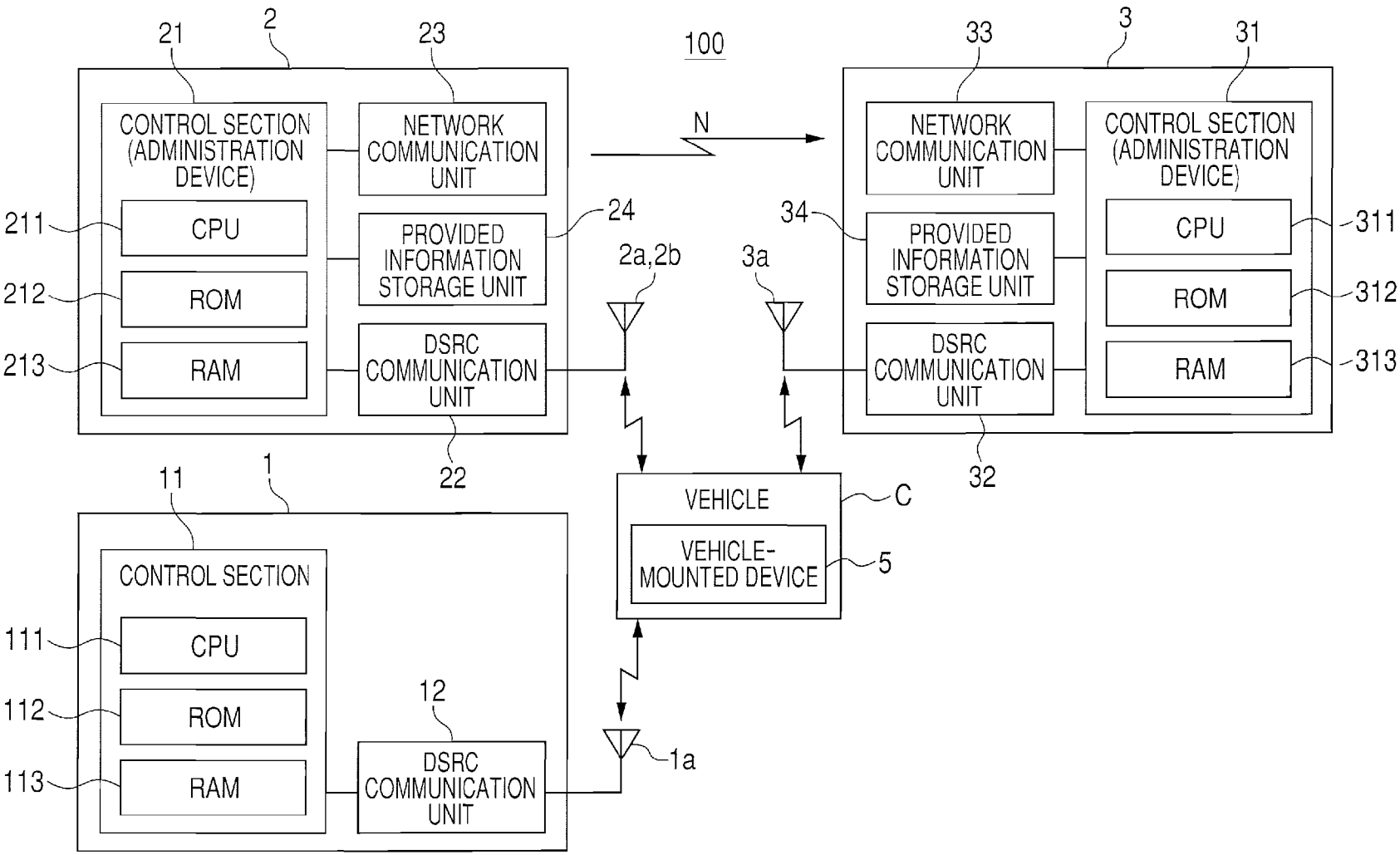
FIG. 4 is an explanatory diagram showing a configuration example of the road-vehicle communication system.

FIG. 4 is an explanatory diagram showing a configuration example of the road-vehicle communication system 100. Specifically, the first roadside apparatus 1, the second roadside apparatus 2, and the third roadside apparatus 3 include processing apparatuses (e.g., computer terminals) including functional blocks shown in FIG. 4.

As shown in FIG. 4, the road-vehicle communication system 100 includes the first roadside apparatus (the ETC entry gate) 1, the second roadside apparatus (the ETC exit gate) 2, and the third roadside apparatus 3, each of which performs road-vehicle communication by DSRC with the vehicle-mounted device 5 mounted on the vehicle C.

The first roadside apparatus 1 includes a control section 11 and a DSRC communication unit 12. The first roadside apparatus 1 may include network communication units 23 and 33 included in the second roadside apparatus 2 and the third roadside apparatus 3 to enable transmission and reception of information with a center apparatus and the like.

The control section 11 includes a CPU 111, a ROM 112, and a RAM 113. The CPU 111 executes, using the RAM 113 as a work area, a control program stored in the ROM 112 to thereby control the DSRC communication unit 12 besides performing various arithmetic operations.

The DSRC communication unit 12 performs, under the control by the control section 11, transmission and reception of information with the vehicle-mounted device 5 mounted on the vehicle C through the DSRC.

For example, the DSRC communication unit 12 always transmits a DSRC radio wave for requesting vehicle identification information for identifying a vehicle to the vehicle-mounted device 5 in order to specify the vehicle C passing through the ETC entry gate.

When the vehicle C passes through the ETC entry gate, since vehicle identification information is transmitted from the vehicle-mounted device 5 mounted on the vehicle C in response to this request, the DSRC communication unit 12 receives this information. When the DSRC communication unit 12 receives the vehicle identification information from the vehicle C, the DSRC communication unit 12 gives, to the vehicle C entry gate, pass information indicating that the vehicle C enters a toll road (passes an entry gate). This entry gate pass information is stored in the vehicle-mounted device 5 and used when, for example, a toll is calculated in the ETC exit gate.

The second roadside apparatus 2 includes a control section 21, a DSRC communication unit 22, a network communication unit 23, and a provided information storage unit 24. The second roadside apparatus 2 is different from the first roadside apparatus 1 in that the second roadside apparatus 2 includes the network communication unit 23 and the provided information storage unit 24.

The control section 21 includes a CPU 211, a ROM 212, and a RAM 213. The CPU 211 executes, using the RAM 213 as a work area, a control program stored in the ROM 212 to thereby control the DSRC communication unit 22 and the network communication unit 23 besides performing various arithmetic operations.

For example, the CPU 211 executes an information providing processing program stored in the ROM 212 to thereby discriminate whether the vehicle C passing though the ETC exit gate is a forward traveling vehicle or a reverse-way traveling vehicle and causes the DSRC communication unit 22 to transmit predetermined information to the vehicle C. This information providing processing is explained in detail later.

As explained above, since the control section 21 performs exchange of information in the second roadside apparatus 2, it can be said that the control section 21 is configured to be capable of communicating with the second roadside apparatus 2. In other words, the control section 21 configures a part of an administration device in the present invention.

A function of the administration device is imparted to the control section 21 of the second roadside apparatus 2, whereby time required for information communication is reduced. This makes it possible to instantaneously provide reverse-way traveling warning information when a reverse-way traveling vehicle passes the roadside area 2 of the second roadside apparatus 2.

The DSRC communication unit 22 performs, under the control by the control section 21, transmission and reception of information with the vehicle-mounted device 5 mounted on the vehicle C through the DSRC.

For example, the DSRC communication unit 12 always transmits a DSRC radio wave for requesting vehicle identification information for identifying a vehicle to the vehicle-mounted device 5 in order to specify the vehicle C passing through the ETC exit gate. At the same time, the DSRC communication unit transmits a DSRC radio wave for requesting entry gate pass information in order to calculate a toll of the toll road.

When the vehicle C passes through the ETC exit gate, since vehicle identification information is transmitted from the vehicle-mounted device 5 mounted on the vehicle C in response to this request, the DSRC communication unit 12 receives this information. Since entry gate pass information is transmitted from the vehicle C normally entering from the toll road, the DSRC communication unit 12 receives this information. Further, the DSRC communication unit 12 transmits payment information based on the entry gate pass information to a passing vehicle traveling forward through the ETC exit gate and transmits reverse-way traveling warning information to a passing vehicle traveling through the ETC gate in a reverse way.

The network communication unit 23 performs transmission and reception of information with the third roadside apparatus 3 via a network N. For example, when the second roadside apparatus 2 detects a reverse-way traveling vehicle, the network communication unit 23 immediately transmits, to the third roadside apparatus 3, an indication that a vehicle traveling in a reverse way on an exit ramp is present.

The provided information storage unit 24 includes, for example, a nonvolatile memory and stores reverse-way traveling warning information provided to the vehicle C in information providing processing explained later. For example, the provided information storage unit 24 stores reverse-way traveling warning information for visually alerting a vehicle traveling in a reverse way on the exit ramp that the vehicle is traveling in a reverse way.

Like the second roadside apparatus 2, the third roadside apparatus 3 includes a control section 31, a DSRC communication unit 32, a network communication unit 33, and a provided information storage unit 34.

The control section 31 includes a CPU 311, a ROM 312, and a RAM 313. The CPU 311 executes, using the RAM 313 as a work area, a control program stored in the ROM 312 to thereby control the DSRC communication unit 32 and the network communication unit 33 besides performing various arithmetic operations.

For example, the CPU 311 executes an information providing processing program stored in the ROM 312 to thereby cause the DSRC communication unit 32 to transmit predetermined information to the vehicle C traveling a main lane. This information providing processing is explained in detail later.

As explained above, since the control section 31 performs exchange of information in the third roadside apparatus 3, it can be said that the control section 31 is configured to be capable of communicating with the third roadside apparatus 3. In other words, the control section 31 configures a part of an administration device in the present invention. The administration device in the present invention includes the control section 21 of the second roadside apparatus 2 and the control section 31 of the third roadside apparatus 3.

The DSRC communication unit 32 performs, under the control by the control section 31, transmission and reception of information with the vehicle-mounted device 5 mounted on the vehicle C through the DSRC. For example, the DSRC communication unit 32 transmits predetermined information to the vehicle C passing through the roadside area Z3 in information providing processing performed by the CPU 311.

The network communication unit 33 performs transmission and reception of information with the second roadside apparatus 2 via the network N. For example, the network communication unit 33 receives reverse-way traveling vehicle information transmitted from the second roadside apparatus 2.

The provided information storage unit 34 includes, for example, a nonvolatile memory and stores information provided to the vehicle C in information providing processing explained later. For example, the provided information storage unit 34 stores reverse-way traveling caution information for visually alerting a vehicle traveling the main lane that a vehicle traveling in a reverse way on the exit ramp is present.

Figure 5:
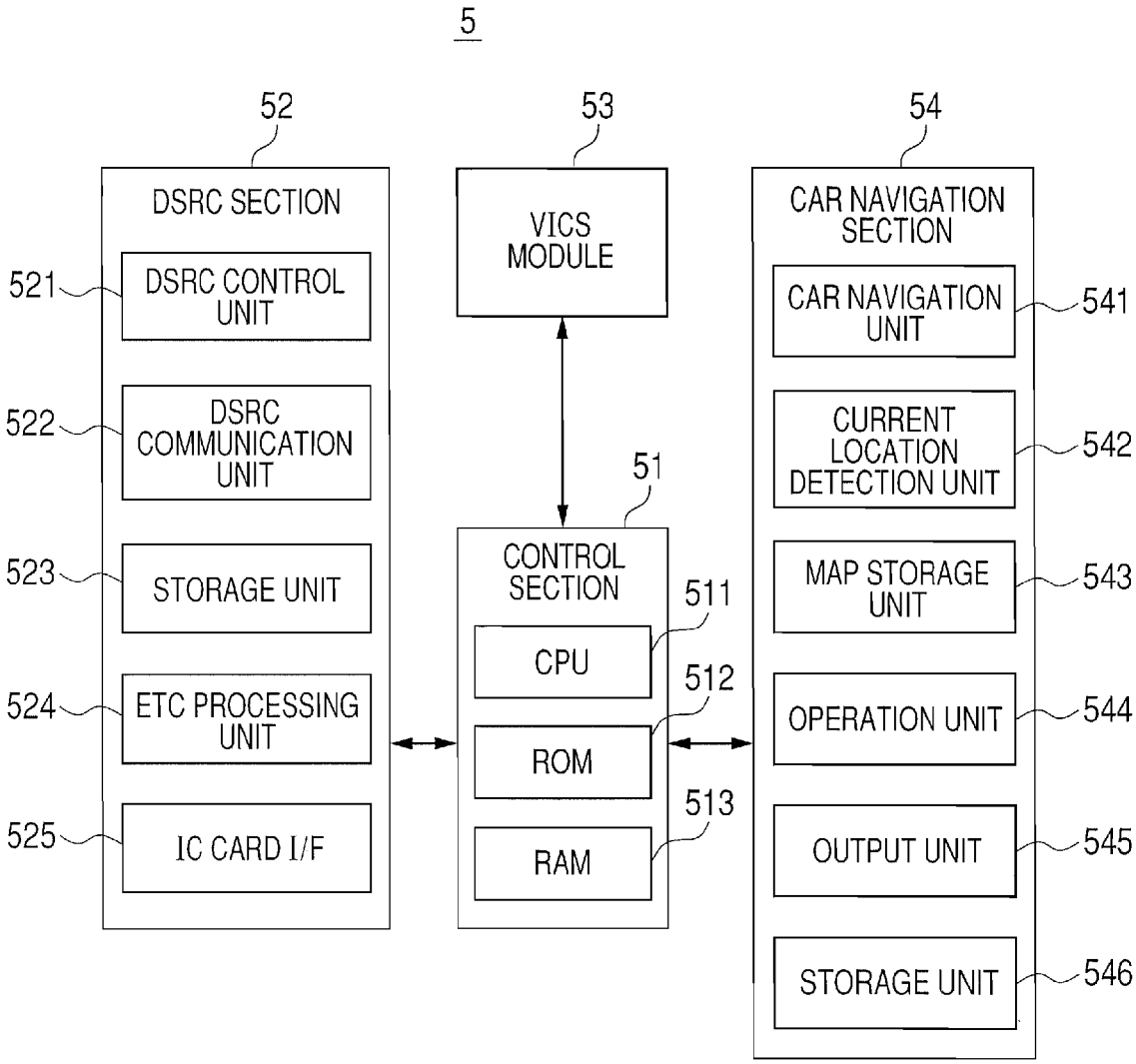
FIG. 5 is a block diagram showing a configuration example of vehicle-mounted device mounted on a vehicle.

FIG. 5 is a block diagram showing a configuration example of the vehicle-mounted device 5 mounted on the vehicle C.

The vehicle-mounted device 5 is an ITS vehicle-mounted device applicable to an ITS (Intelligent Transport System). For example, in the conventional road-vehicle communication system, the vehicle-mounted device 5 receives content information or the like transmitted from a center apparatus via a roadside apparatus and stores or outputs the content information or the like.

Further, in the road-vehicle communication system 100 according to this embodiment, the vehicle-mounted device 5 performs communication by the DSRC with the first roadside apparatus 1, the second roadside apparatus 2, and the third roadside apparatus 3 and transmits vehicle identification information or the like to the first roadside apparatus 1 and the second roadside apparatus 2. On the other hand, the vehicle-mounted device 5 receives provided information transmitted from the second roadside apparatus 2 and the third roadside apparatus 3 and outputs or stores the provided information.

As shown in FIG. 5, the vehicle-mounted device 5 includes a control section 51, a DSRC section 52, a VICS module 53, and a car navigation section 54.

The control section 51 includes a CPU 511, a ROM 512, and a RAM 513. The CPU 511 executes, using the RAM 513 as a work area, a control program stored in the ROM 512 to thereby perform concentrated control of the sections besides performing various arithmetic operations.

For example, when the vehicle-mounted device 5 performs the communication by the DSRC with the first roadside apparatus 1, the second roadside apparatus 2, and the third roadside apparatus 3, the CPU 511 controls communication operation of the DSRC section 52. In the control of the DSRC section 52, the CPU 511 performs the control in cooperation with a DSRC control unit 521 of the DSRC section 52.

Specifically, when the DSRC radio wave for requesting vehicle identification information always originated from the first roadside apparatus 1 or the second roadside apparatus 2 is received in the DSRC section 52, the CPU 511 controls the DSRC section 52 to transmit this information to the first roadside apparatus 1 or the second roadside apparatus 2.

When the DSRC radio wave for requesting entry gate pass information always originated from the second roadside apparatus 2 is received in the DSRC section 52, the CPU 511 controls the DSRC section 52 to transmit this information to the second roadside apparatus 2.

When provided information transmitted from the second roadside apparatus 2 or the third roadside apparatus 3 is received in the DSRC section 52, the CPU 511 controls the car navigation section 54 to output this provided information and controls the DSRC section 52 (an ETC processing unit 524) to perform charging based on payment information.

The DSRC section 52 includes the DSRC control unit 521, a DSRC communication unit 522, a storage unit 523, the ETC processing unit 524, and an IC card interface 525. The DSRC section 52 performs processing for communicating with a roadside apparatus and an ETC base station through the DSRC.

The DSRC control unit 521 includes a CPU, a ROM, and a RAM (all of which are not shown in the figure) and controls the operation of the units of the DSRC section 52 in cooperation with a control program stored in the ROM.

For example, when payment by the ETC is performed, the DSRC control unit 521 controls communication operation of the DSRC communication unit 522 to perform transmission and reception of payment information with the second roadside apparatus 2. The DSRC control unit 521 controls the ETC processing unit 524 to perform processing for writing the payment information in an IC of a credit card or the like.

For example, if content information is received by the DSRC communication unit 522 from a center apparatus via a roadside apparatus, the DSRC control unit 521 transfers the content information to the control section 51. If provided information is received by the DSRC communication unit 522 via the second roadside apparatus 2 or the third roadside apparatus 3, the DSRC control unit 521 transfers the provided information to the control section 51.

The DSRC communication unit 522 includes an antenna installed on the dashboard and near the windshield of the vehicle C. The DSRC communication unit 522 performs communication by the DSRC with the roadside apparatus and the ETC base station via this antenna.

The storage unit 523 includes, for example, a nonvolatile memory and stores vehicle-mounted device ID attached to the vehicle-mounted device 5, vehicle information concerning the vehicle C mounted with the vehicle-mounted device 5, and the like.

The vehicle-mounted device ID is vehicle-mounted device information attached to each vehicle-mounted device during manufacturing. The vehicle information includes license plate information and vehicle type information (a large vehicle, a medium vehicle, a small vehicle, a handicapped driver vehicle, etc.) of the vehicle C mounted with the vehicle-mounted device 5. The vehicle information is registered when the vehicle-mounted device 5 is mounted on the vehicle C (setup).

The vehicle-mounted device ID and the vehicle information are transmitted to the first roadside apparatus 1 and the second roadside apparatus 2 as vehicle identification information.

Since the first roadside apparatus 1 and the second roadside apparatus 2 acquire the vehicle-mounted device ID or the license plate information as the vehicle identification information, it is possible to accurately specify the vehicle C passing through the roadside area Z1 or Z2 of the first roadside apparatus 1 or the second roadside apparatus 2.

The ETC processing unit 524 writes the payment information or the like, which is transmitted from the ETC exit gate (the second roadside apparatus 2*a*), in and reads the payment information or the like from a credit card, a debit card, or the like with an IC inserted into and removed from the IC card interface 525.

The IC card interface 525 includes a slot for a credit card and the like and mediates exchange of information between an IC of a credit card or the like inserted into this slot and the ETC processing unit 524.

The VICS module 53 includes antennas respectively for optical communication, FM communication, and 2.4 GHz radio wave communication and performs the optical communication, the FM communication, and the radio wave communication with a VICS (Vehicle Information and Communication System) center. The VICS module 33 receives traffic jam information, road traffic information, or the like from the VICS center and transfers the information to the control section 51.

The car navigation section 54 includes a car navigation unit 541, a current location detection unit 542, a map storage unit 543, an operation unit 544, an output unit 545, and a storage unit 546. The car navigation section 54 performs processing for guiding the vehicle C to a guide path.

The car navigation unit 541 calculates, on the basis of information concerning a current location acquired from the current location detection unit 542, map information stored in the map storage unit 543, and the like, a guide path from the current location of the vehicle C to a destination set via the operation unit 544. The car navigation unit 541 generates, using the map information stored in the map storage unit 543, a map screen for guiding the vehicle C to the calculated guide path and causes a display of the output unit 545 to display the map screen.

The current location detection unit 542 includes a GPS (Global Positioning System) and a gyro sensor.

The GPS receives a GPS signal transmitted from a GPS satellite and calculates an own-vehicle location (the latitude and the longitude) on the basis of the GPS signal.

The gyro sensor detects acceleration (rotating speed in the horizontal direction per unit time) of a vehicle indicating an amount of change in a moving direction (an angular velocity sensor) and performs detection of geomagnetism (an azimuth sensor) to detect an absolute azimuth of the own vehicle.

The current location detection unit 542 generates, on the basis of information acquired from the GPS and the gyro sensor, current location information (information concerning the latitude, the longitude, etc.) indicating the current location of the vehicle and information concerning traveling speed and transfers the information to the car navigation unit 541.

The map storage unit 543 includes a storage medium such as a hard disk or a DVD and stores map information necessary for guidance display.

The operation unit 544 includes hard keys provided in a main body of the vehicle-mounted device, a touch panel (soft keys) integrally provided in the display of the output unit 545, or a remote controller. When key operation is performed by a user, the operation unit 544 generates an operation signal corresponding to this operation and outputs the operation signal to the control section 31.

The output unit 545 includes a display and a loudspeaker. The display performs screen display guidance according to the control by the control section 51. The output unit 545 displays, for example, a setting screen, a map screen, and a display screen for content information received from the center apparatus of the road-vehicle communication system. The loudspeaker performs sound guidance according to the control by the control section 51.

The storage unit 546 includes, for example, a readable and writable semiconductor memory. The storage unit 546 stores, for example, a guide information (road information, traffic jam information, etc.) received via the VICS module and a traveling history of a vehicle.

Figure 6:
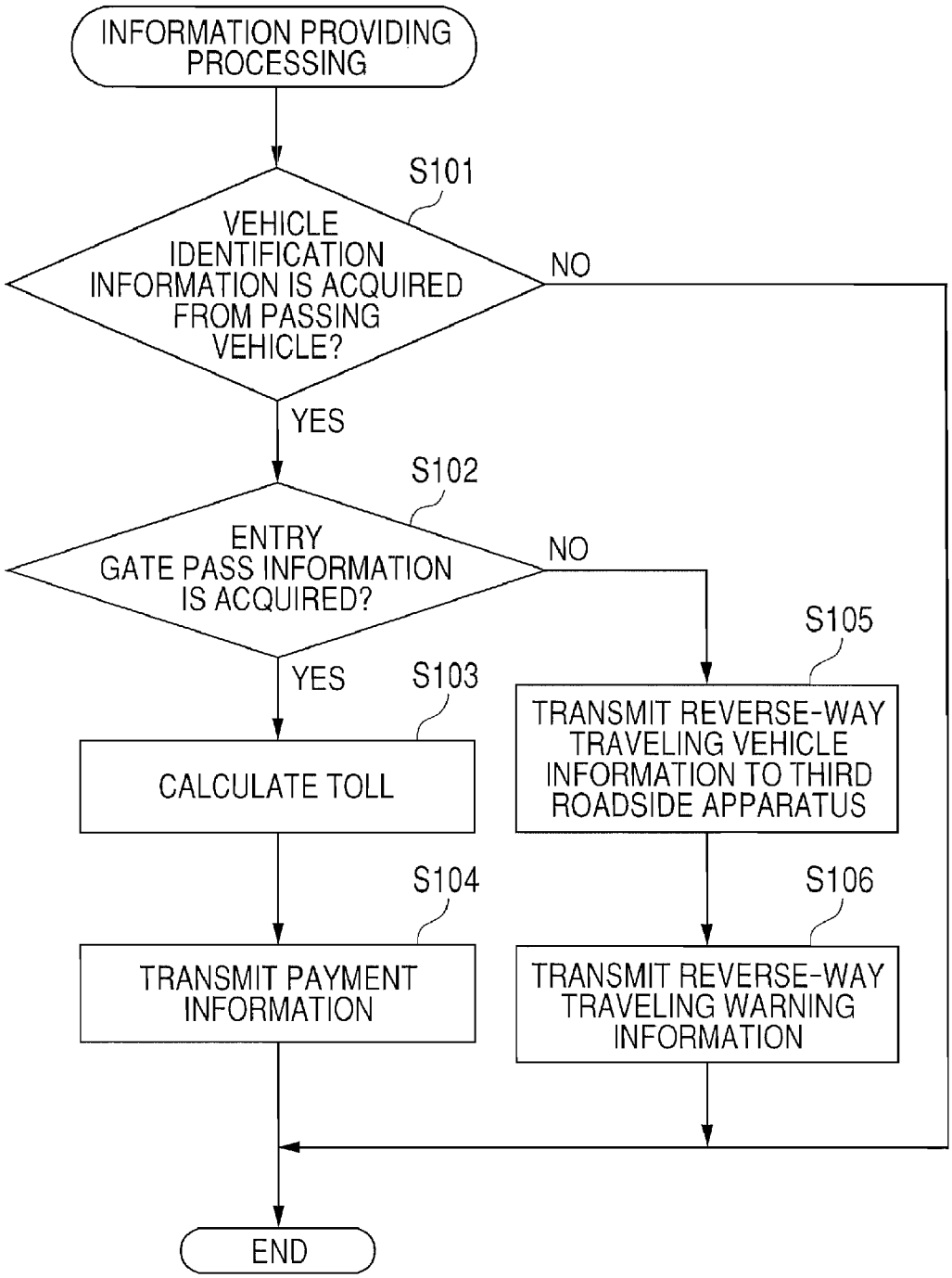
FIG. 6 is a flowchart showing an example of information providing processing executed in a second roadside apparatus.

FIG. 6 is a flowchart showing an example of information providing processing executed in the second roadside apparatus 2. This information providing processing is realized by the CPU 211 executing an information providing processing program in the ROM 212 in the second roadside apparatus 2.

In step S101, the CPU 211 judges whether vehicle identification information is acquired from a vehicle passing through the ETC exit gate. Since the second roadside apparatus 2 is always transmitting a DSRC radio wave for requesting vehicle identification information and entry gate pass information to a vehicle passing through the ETC exit gate, the passing vehicle transmits the vehicle identification information and the entry gate pass information in response to this request. However, since a vehicle not passing through the ETC entry gate (a reverse-way traveling vehicle) does not have entry gate pass information, the entry gate pass information is not transmitted to the second roadside apparatus 2.

If the CPU 211 judges that the vehicle identification information is acquired from the passing vehicle (a forward traveling/reverse-way traveling vehicle is present), the CPU 211 shifts to step S102. If the CPU 211 judges that the vehicle identification information is not acquired (a passing vehicle is absent), the CPU 211 ends the processing.

In step S102, the CPU 211 judges whether entry gate pass information is also acquired from the vehicle C from which the vehicle identification information is acquired in step S101. If the entry gate pass information is acquired, the vehicle C is a vehicle that has passed through the ETC entry gate and traveled the main lane of the toll road. On the other hand, if the entry gate pass information is not acquired, the vehicle C is a vehicle that has not passed through the ETC entry gate, i.e., a vehicle attempting to travel in a reverse way and enter the main lane of the toll road from the exit ramp.

If the CPU 211 judges that the entry gate pass information is acquired, the CPU 211 shifts to step S103. If the CPU 211 judges that the entry gate pass information is not acquired, the CPU 211 shifts to step S105.

In step S103, the CPU 211 calculates a toll corresponding to a traveling section of the toll road on the basis of the acquired entry gate pass information. When the toll depends on a vehicle type, the CPU 211 may acquire vehicle type information (stored in the vehicle-mounted device 5) simultaneously with the vehicle identification information.

In step S104, the CPU 211 transmits payment information indicating the toll to the vehicle-mounted device 5 of the passing vehicle. The ETC processing unit 524 of the vehicle-mounted device 5 performs charging processing (writing in a credit card with an IC, etc.) based on this payment information.

In step S105, the CPU 211 transmits, to the third roadside apparatus 3, reverse-way traveling vehicle information indicating that a reverse-way traveling vehicle traveling on the exit ramp in a reverse way is detected.

In step S106, the CPU 211 transmits, to the reverse-way traveling vehicle, reverse-way traveling warning information for warning the reverse-way traveling vehicle that the own vehicle is traveling in a reverse way.

For example, as shown in FIG. 1, when the vehicle Cc travels on the exit ramp L1out in a reverse way and passes through the second roadside apparatus (the ETC exit gate) 2*a*, since the vehicle-mounted device 5 of the vehicle Cc does not have entry gate pass information, reverse-way traveling warning information is transmitted. On the other hand, in the vehicle-mounted device 5 of the vehicle Cc, the car navigation section 54 performs output based on the reverse-way traveling warning information.

Figure 8:
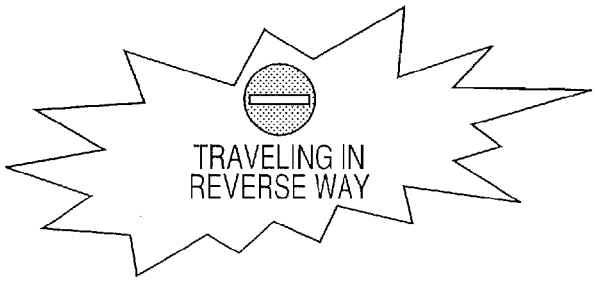
FIG. 8 is an explanatory diagram showing a display example of reverse-way traveling warning output to a display of a car navigation section.

For example, a screen shown in FIG. 8 is displayed on the display of the output unit 545 of the car navigation section 54. According to this screen display, a driver can learn that the own vehicle is traveling in a reverse way and turns back on the exit ramp L1out before merging into the main lane L1*m*. Therefore, it is possible to prevent a reverse-way traveling accident from occurring on the main lane L1*m*.

When a vehicle traveling forward and attempting to pass through the ETC exit gate on the exit ramp is present, a traveling direction of the vehicle can be easily recognized. Therefore, an event that the vehicle travels in a reverse way on the exit ramp and merges into the main lane hardly occurs. Specifically, when the vehicle is provided with reverse-way traveling warning information, since the exit ramp is considered be not crowded, the vehicle can make a U-turn and easily turns back.

As explained above, the road-vehicle communication system 100 according to this embodiment includes the first roadside apparatus 1 that is provided on the entrance ramp of the toll road and gives, to a vehicle passing through the communicable range, the entry gate pass information indicating that the vehicle enters the toll road and the second roadside apparatus 2 that is provided on the exit ramp of the toll road and acquires, from the vehicle passing through the communicable range, the entry gate pass information given by the first roadside apparatus 1 (including a case in which no entry gate pass information is present).

The second roadside apparatus 2 having the function of the administration device judges whether the entry gate pass information is acquired. If this entry gate pass information is not acquired, the second roadside apparatus 2 provides the vehicle with reverse-way traveling warning information for warning the vehicle that the vehicle is traveling in a reverse way.

Therefore, with the road-vehicle communication system 100, it is possible to judge, according to a traveling form on the exit ramp, a vehicle extremely fully expected to travel the main lane of the toll road in a reverse way and it is possible to perform warning for reverse-way traveling prevention for this vehicle. Therefore, it is possible to effectively prevent a reverse-way traveling accident.

In this embodiment, the first roadside apparatus is provided in the ETC entry gate of the entrance ramp and the second roadside apparatus 2 is provided in the ETC exit gate of the exit ramp. Specifically, in the past, a vehicle traveling in a reverse way on the exit ramp is specified by using the entry gate pass information given in the ETC entry data in order to calculate a toll.

In this way, since it is possible to realize the present invention using the technique used in the ETC, it is possible to effectively utilize the conventional road system.

Figure 7:
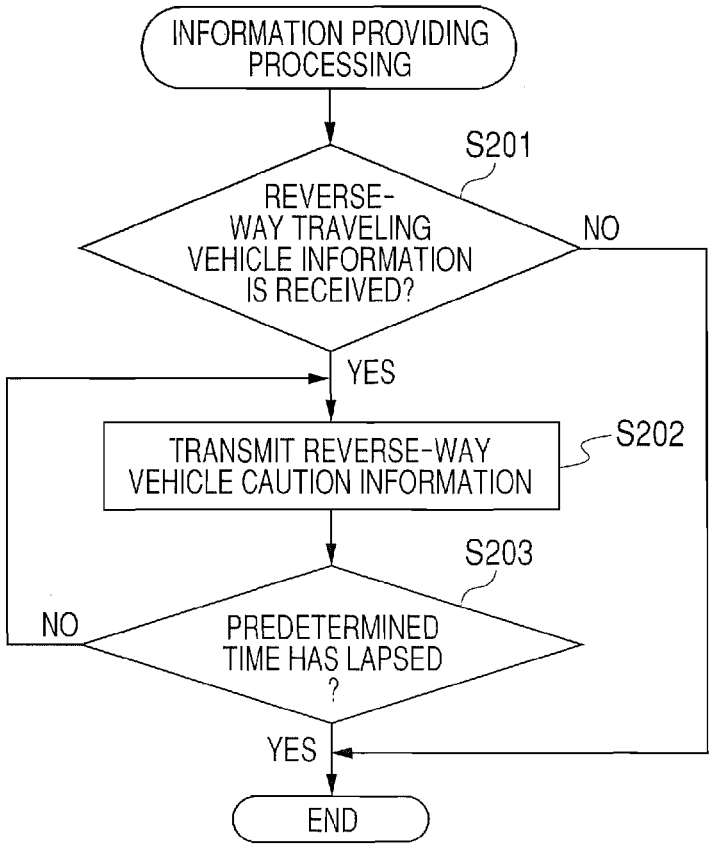
FIG. 7 is a flowchart showing an example of information providing processing executed in a third roadside apparatus.

FIG. 7 is a flowchart showing an example of information providing processing executed in the third roadside apparatus 3. This information providing processing is realized by the CPU 311 executing an information providing processing program in the ROM 312 in the third roadside apparatus 3.

In step S201, the CPU 311 judges whether reverse-way traveling vehicle information transmitted from the second roadside apparatus 2 is received. If the reverse-way traveling vehicle information is received, the CPU 311 shifts to step S202. If the reverse-way traveling vehicle information is not received, the CPU 311 ends the processing.

In step S202, the CPU 311 transmits, to a vehicle traveling the main lane, reverse-way traveling vehicle caution information for alerting the vehicle that a reverse-way traveling vehicle traveling in a reverse way on the exit ramp and attempting to enter the main lane is present.

In step S203, the CPU 311 judges whether a predetermined time set in advance has lapsed. When the predetermined time has lapsed, the CPU 311 ends the processing. For example, as the predetermined time, the CPU 311 predicts and sets time required for the reverse-way traveling vehicle to travel on the exit ramp and pass the third roadside apparatus 3.

Specifically, until the reverse-way traveling vehicle enters the main lane, the CPU 311 continuously performs transmission of the reverse-way traveling vehicle caution information to the vehicle traveling the main lane.

For example, as shown in FIG. 1, when the vehicle Cc travels in a reverse way on the exit ramp L1out and passes through the second roadside apparatus (the ETC exit gate) 2*a*, reverse-way traveling vehicle information is transmitted from the second roadside apparatus 2 to the third roadside apparatus 3 (step S105 in FIG. 6) and the reverse-way traveling vehicle caution information is transmitted to the vehicle C traveling the main lane L1*m*. On the other hand, in the vehicle-mounted device 5 of the vehicle C traveling the main lane Lm, the car navigation section 54 performs output based on the reverse-way traveling vehicle caution information.

Figure 9:
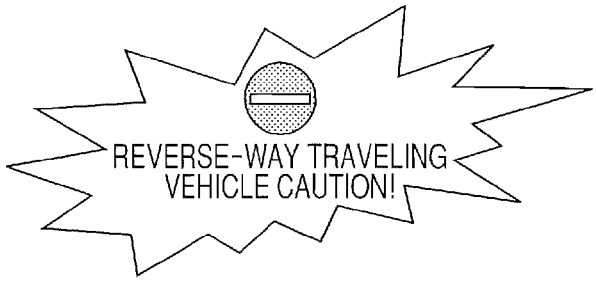
FIG. 9 is an explanatory diagram showing a display example of a reverse-way traveling vehicle caution output to the display of the car navigation section.
Figure 10:
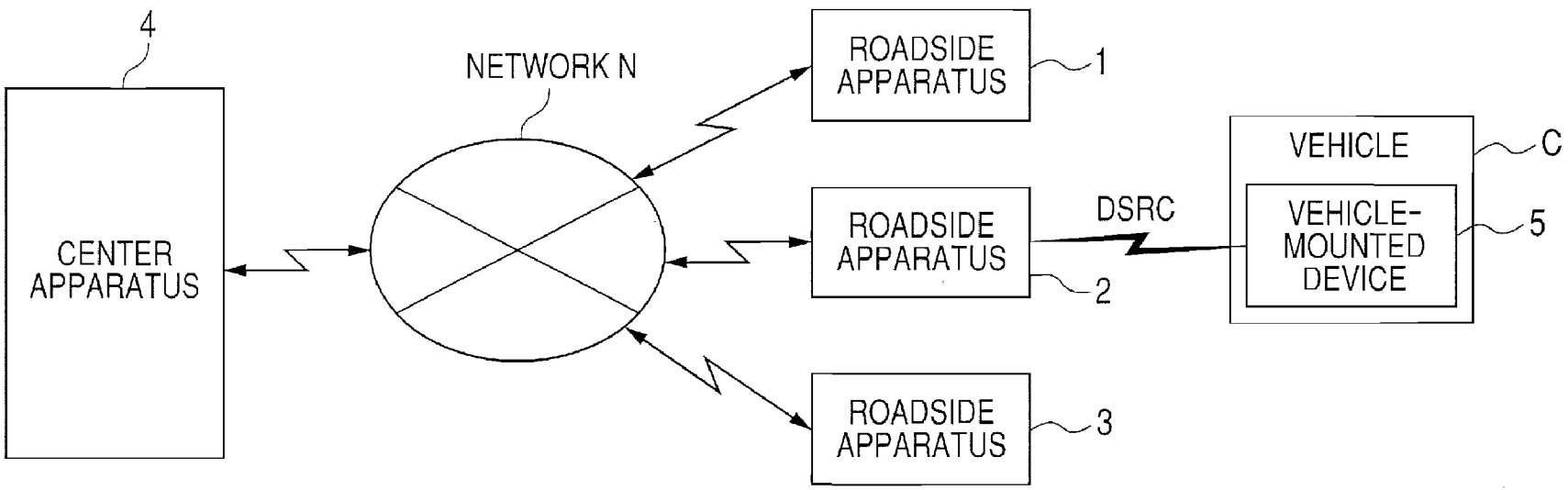
FIG. 10 is a schematic diagram showing another configuration example of the road-vehicle communication system.

For example, a screen shown in FIG. 9 is displayed on the display of the output unit 545 of the car navigation section 54. According to this screen display, a driver can learn the presence of the reverse-way traveling vehicle and take a measure by, for example, moving to and traveling a passing lane in advance to prevent a reverse-way traveling accident.

As explained above, the road-vehicle communication system 100 according to this embodiment includes the third roadside apparatus 3 that is provided further on the upstream side than the turning point to the exit ramp of the main lane of the toll road and performs short-range communication with the vehicle-mounted device 5 mounted on the vehicle C.

When the third roadside apparatus 3 having the function of the administration device receives the reverse-way traveling vehicle information from the second roadside apparatus 2, the third roadside apparatus 3 provides the vehicle C traveling the main lane with the reverse-way traveling vehicle caution information for cautioning that the reverse-way traveling vehicle is present.

In this way, it is possible to provide the vehicle C traveling the main lane of the toll road with the reverse-way traveling vehicle caution information and cause the vehicle C to take a measure to avoid the reverse-way traveling vehicle. Therefore, even if the reverse-way traveling vehicle directly enters the main lane, it is highly likely that a reverse-way traveling accident can be prevented.

The invention devised by the inventor has been specifically explained on the basis of the embodiment. However, the present invention is not limited to the embodiment and can be changed in a range without departing from the spirit of the present invention.

For example, while the reverse-way traveling warning information is not transmitted in 2*b* of the second roadside apparatus 2, caution information for urging check of insertion of an ETC card may be broadcasted. In the embodiment, the second roadside apparatus 2 and the third roadside apparatus 3 include the administration devices. However, as shown in FIG. 9, a center apparatus 4 as an administration device may be separately provided on the network N to enable the center apparatus 4 and the second roadside apparatus 2 and the third roadside apparatus 3 to communicate with each other. In this case, the center apparatus 4 executes processing equivalent to the information providing processing shown in FIGS. 6 and 7.

The vehicle-mounted device 5 may output sound from the loudspeaker on the basis of the reverse-way traveling warning information and the reverse-way traveling vehicle caution information rather than simply outputting a video to the display of the output unit 545 of the car navigation section 54. This can be easily realized if the reverse-way traveling warning information and the reverse-way traveling vehicle caution information include sound information.

In the embodiment, the third roadside apparatus continues to transmit the reverse-way traveling vehicle caution information until a predetermined time lapses. However, the third roadside apparatus 3 may be caused to stop the transmission of the reverse-way traveling vehicle caution information when the third roadside apparatus 3 detects that the reverse-way traveling vehicle makes a U-turn and turns back on the exit ramp.

For example, the second roadside apparatus 2 stores vehicle identification information of a reverse-way traveling vehicle in advance and judges, when the vehicle identification information of the reverse-way traveling vehicle is acquired again, that the reverse-way traveling vehicle turns back. Consequently, since it is possible to prevent wrong alert from being given to the vehicle C traveling the main lane of the toll road, the road-vehicle communication system 100 does not thoughtlessly cause a driver to feel a danger.

The embodiment disclosed herein should be considered illustrative in every aspect and not limiting. The scope of the present invention is indicated by the scope of the patent claims rather than the above explanation. It is intended that all changes within meanings and scopes equivalent to the scope of the patent claims are included in the present invention.

The invention claimed is:

1. A road-vehicle communication system, comprising:

a first roadside apparatus, provided in an entrance ramp of a toll road, configured to give entry gate pass information to vehicles passing through a communicable range;

a second roadside apparatus, provided in an exit ramp of the toll road, configured to acquire from a passing vehicle any entry gate pass information given by the first roadside apparatus;

a third roadside apparatus, provided further on an upstream side than a turning point to the exit ramp of a main lane of the toll road, configured to perform short-range communication with a vehicle-mounted device mounted on a vehicle traveling on the main lane of the toll road; and an administration device configured to communicate with the second roadside apparatus, wherein the administration device is configured to judge whether the entry gate pass information is acquired from the passing vehicle by the second roadside apparatus and provide, if entry gate pass information is not acquired, via the second roadside apparatus, reverse-way traveling warning information for warning the passing vehicle that the passing vehicle is traveling in a reverse way, and wherein the administration device is configured to communicate with the third roadside apparatus and provide, if the entry gate pass information is not acquired from the passing vehicle by the second roadside apparatus, via the third roadside apparatus, reverse-way traveling vehicle warning information for alerting the vehicle traveling the main lane of the toll road that a reverse-way traveling vehicle is present.

2. The road-vehicle communication system according to claim 1, wherein the second roadside apparatus is configured to acquire vehicle identification information from the passing vehicle, and the administration device is configured to store, if the entry pass gate information is not acquired from the passing vehicle by the second roadside apparatus, vehicle identification information of the passing vehicle in advance and stop the provision of the reverse-way traveling vehicle warning information when the vehicle identification information of the passing vehicle is acquired by the second roadside apparatus again.

3. The road-vehicle communication system according to claim 1, wherein the first roadside apparatus is provided in an ETC entry gate.

4. The road-vehicle communication system according to claim 1, wherein the second roadside apparatus is provided in an ETC exit gate, and the administration device is configured to calculate, if the entry gate pass information is acquired from the passing vehicle by the second roadside apparatus, a toll corresponding to a traveling section of the toll road on the basis of the entry gate pass information and provide the vehicle with payment information via the second roadside apparatus.

5. The road-vehicle communication system according to claim 1, wherein the entry gate pass information is stored in a vehicle-mounted device.

* * * * *